US005555940A

United States Patent [19]

Fujiki

[11] Patent Number: 5,555,940

[45] Date of Patent: Sep. 17, 1996

[54] AUTOMATIC GAS INJECTION FIRE EXTINGUISHER

[75] Inventor: Masaru Fujiki, Tokyo, Japan

[73] Assignee: Glory Kiki Co., Ltd., Himeji, Japan

[21] Appl. No.: 237,038

[22] Filed: May 3, 1994

[51] Int. Cl.[6] ..... A62C 35/13

[52] U.S. Cl. ..... 169/60; 169/11; 169/26

[58] Field of Search ..... 169/11, 19, 26, 169/60

[56] References Cited

U.S. PATENT DOCUMENTS

| | | | |
|---|---|---|---|
| 2,479,801 | 8/1949 | Woodworth | 169/58 |
| 3,889,752 | 6/1975 | Dunn | 169/26 X |
| 3,893,514 | 7/1975 | Carhart et al. | 169/11 X |
| 4,175,677 | 11/1979 | Poeschl et al. | 222/5 |
| 4,377,209 | 3/1983 | Golben | 169/26 |
| 4,848,388 | 7/1989 | Waldbusser | 137/80 |
| 4,972,910 | 11/1990 | Fujiki | 169/60 |
| 5,123,490 | 6/1992 | Jenne | 169/26 X |

FOREIGN PATENT DOCUMENTS

| | | | |
|---|---|---|---|
| 310439 | 4/1989 | European Pat. Off. . | |
| 2-121680 | 5/1990 | Japan . | |
| 1136625 | 12/1968 | United Kingdom | 169/26 |
| 2203646 | 10/1988 | United Kingdom . | |

*Primary Examiner*—Andrew C. Pike
*Attorney, Agent, or Firm*—Browdy and Neimark

[57] ABSTRACT

In order to carry out a two-stage fire extinguishing operation consisting of a cooling fire extinguishing step and an oxygen deficiency fire extinguishing step using a fire extinguishing gas in a closed space, a plurality of fire extinguishers are each provided with a firing pin unit for breaking a seal member of a cylinder, a retainer for maintaining the firing pin unit in a non-operative state, and a retainer operating device for operating the retainer by an automatic operation. The retainer is fixed at its head portion by a bolt screwed to an upper surface portion of a fixing member, and the leg portions of the retainer are fitted in a recess formed in an upper portion of a shaft to a lower end portion of which the firing pin is fixed. The retainer operating unit consists of a tapering shaft member, which is adapted to be pressed by a spring of a shape memory metal expandable at a predetermined temperature, whereby the leg portions of the retainer are opened to operate the firing pin.

7 Claims, 5 Drawing Sheets

AUTOMATIC GAS INJECTION FIRE EXTINGUISHER

BACKGROUND OF THE INVENTION

1. Field of the Invention

The present invention relates to an automatic gas injection fire extinguisher.

2. Description of the Prior Art

Various types of fire extinguishers have heretofore been produced. One known example of the fire extinguishers is a gas fire extinguisher which uses a cylinder filled with a fire extinguishing gas, such as a fluorocarbon gas or carbon dioxide in a liquefied state, and which is adapted to eject the gas as a fire extinguishing agent by manually breaking a seal member of this cylinder. The known fire extinguishers also include a fire extinguisher adapted to eject a powdered or water soluble fire extinguishing agent with a gas pressure.

Among these conventional fire extinguishers, a gas fire extinguisher is adapted to eject a gas manually, so that a fire extinguishing action takes much time. Regarding, especially, a gas fire extinguisher using a fluorocarbon gas, the discontinuance of use of the same gas was decided under the international treaty for the improvement of the earth environment, and it is therefore necessary to develop a substitute for a fluorocarbon gas. When a fire extinguisher adapted to eject a powdered or water soluble fire extinguishing agent is used practically, the machines, instruments, clothes, and documents installed, stored, and placed in a room are damaged greatly due to the deposition of the fire extinguishing agent thereon during a fire extinguishing operation.

SUMMARY OF THE INVENTION

Accordingly, it is an object of the present invention to provide an automatic gas injection fire extinguisher. The extinguisher is capable of improving fire extinguishing performance by utilizing a two-stage fire extinguishing function which is actuated automatically. The first stage has a cooling fire extinguishing function based on a super-low temperature due to gasification of latent heat occurring when a gas, such as a carbon dioxide gas contained in a liquefied state in a cylinder, is ejected and gasified. The second stage has an oxygen deficiency fire extinguishing function based on an oxygen deficient condition in a room occurring due to the explosive expansion of the gasified liquefied-state gas. The fire extinguishing operation is rapidly activated by carrying out the automatic ejection of a fire extinguishing gas when a predetermined temperature is reached.

Another object of the present invention is to provide a high performance automatic gas injection fire extinguisher, capable of carrying out a fire extinguishing operation speedily without soiling various kinds of equipment, documents, curios, and objects of art in a room.

The fire extinguisher according to the present invention comprises a cylinder which is filled with a fire extinguishing gas in a liquid state which can be either carbon dioxide or nitrogen or a combination of both. The liquified gas has a cooling fire extinguishing function based on gasification latent heat of the liquified gas when gasified and an oxygen deficiency fire extinguishing function based on expansion thereof. The cylinder is sealed with a seal member. The fire extinguisher has a firing pin unit for breaking the seal member on the cylinder, a cylinder receiving unit for retaining the cylinder and supporting the firing pin unit, a fixing unit for supporting the cylinder receiving unit, a retainer unit for maintaining the firing pin unit in an inoperative state, and a retainer operating device for releasing the retainer unit at a predetermined temperature. The retainer operating unit has a spring formed from a metal with a shape memory which is normally maintained in a slightly compressed state, and which extends at a predetermined temperature, thereby actuating the firing pin unit.

The fire extinguisher according to the present invention is preferably formed so that the fixing unit has a cylindrical member surrounding the cylinder receiving unit to provide a clearance between one end portion of this member and the cylinder.

The fire extinguisher according to the present invention is preferably formed so that the cylinder has a thread on the outer circumferential surface of a head portion thereof. The cylinder receiving unit has a first axial bore or hollow portion which communicates with a second axial bore having a slightly larger diameter. This forms a first stepped portion between the bores. A thread is formed in the first axial bore at the first end of the receiving unit which corresponds to the thread on the cylinder. Ejection ports are provided on the receiving unit above its thread. A second stepped portion is formed near the second end of the receiving unit by making the outer diameter of a length of the receiving unit greater than the diameter of its remaining length.

The fire extinguisher according to the present invention is preferably so formed that the firing pin unit consists of a shaft which has a flange at a first end portion thereof. An 0-ring is fitted in a first recess at a second end portion of the shaft. The retainer unit is fitted in a second recess on a second end of the shaft. The second recess is spaced above the first recess. The shaft is inserted into the receiving unit. A firing pin projects from the first end portion of the shaft. A spring is provided in a compressed state between the flange of the shaft and the first stepped portion of the receiving unit.

The fire extinguisher according to the present invention is preferably so formed that the fixing unit consists of a fixing member provided on the inner side thereof with a through bore through which the receiving unit is passed. The second stepped portion of the receiving unit engages a third stepped portion on the fixing unit when inserted in the through bore of the fixing unit.

The fire extinguisher according to the present invention is preferably so formed that the retainer unit has a head portion and leg portions which are fitted in the second recess in the second end portion of the shaft of the firing pin unit. A first bolt is inserted into and engages with the fixing member of the fixing unit so that the head portion of the retainer unit can be engaged to the fixing unit.

The fire extinguisher according to the present invention is preferably so formed that the retainer operating device consists of a tapering shaft member having a tapering portion inserted between the leg portions of the retainer unit, a safety pin provided below the tapering shaft member, a second bolt screwed to said fixing unit through the tapering shaft member and the safety pin, a spring with a shape memory is applied to the head portion of the tapering shaft member to urge the shaft, and a connector which has a pair of connector members joined to each other pivotably by a pin, and which are engaged to the head portion of the fixing member so that one of the connector members can be rotatable to keep the connector pressed against the spring.

A plurality of fire extinguishers according to the present invention are set in a predetermined position in a room, a storage space, a cabinet, or a computer room; an engine room; a motor compartment, a panel room, a power source compartment, or a boiler room in a ship or a vehicle; a container for inflammables; an automatic generator room; a heater room; a depository for valuables; a library; work of art storage room; and a cabinet for inflammable electric appliances or gas fittings. The number of the automatic gas injection fire extinguishers to be set is regulated suitably on the basis of the capacity or volume of the room, the storage, or the cabinet.

When a fire extinguisher according to the present invention is set, so that the temperature reaches a predetermined level, the spring of a metal with a shape memory is deformed to press the retainer via the tapering shaft. Consequently, the retainer thus pressed is opened slightly by the tapering portion of the tapering shaft member. Thereafter the firing pin is moved down owing to the expansive force of a spring provided between the receiving unit and the shaft. The downward movement of the shaft causes the firing pin to be moved down suddenly to break the seal member of the cylinder with its sharp free end portion.

After these steps are carried out, the cylinder is unsealed, and the fire extinguishing gas with which the cylinder is filled is ejected therefrom. The gas thus ejected fills the cylindrical member through the ejection ports, and is jetted automatically from the clearance formed between the lower portion of the cylindrical member and the cylinder to the space around the cylinder. During this time, the temperature of the gas ejected and gasified becomes super-low, so that the room temperature decreases suddenly, whereby the cooling extinguishing of the fire is carried out. The gasified gas expands explosively to cause the interior of a room or storage space to be put in an oxygen-deficient condition, whereby the oxygen deficiency extinguishing of the fire is carried out. In the fire extinguishers according to the present invention, the seal member is broken automatically at a predetermined temperature. Therefore, the time between the breakage of the seal member and the starting of ejection of the fire extinguishing gas is short, and a fire extinguishing operation is started very rapidly. Moreover, the fire extinguishing gas used in the present invention does not cause various kinds of equipment, important goods, and documents to be laid under water and soiled.

The above and other objects, features, and advantages of the present invention will become apparent from the following detailed description which is to be read in conjunction with the accompanying drawings.

DESCRIPTION OF THE PREFERRED EMBODIMENT

Figure 1:
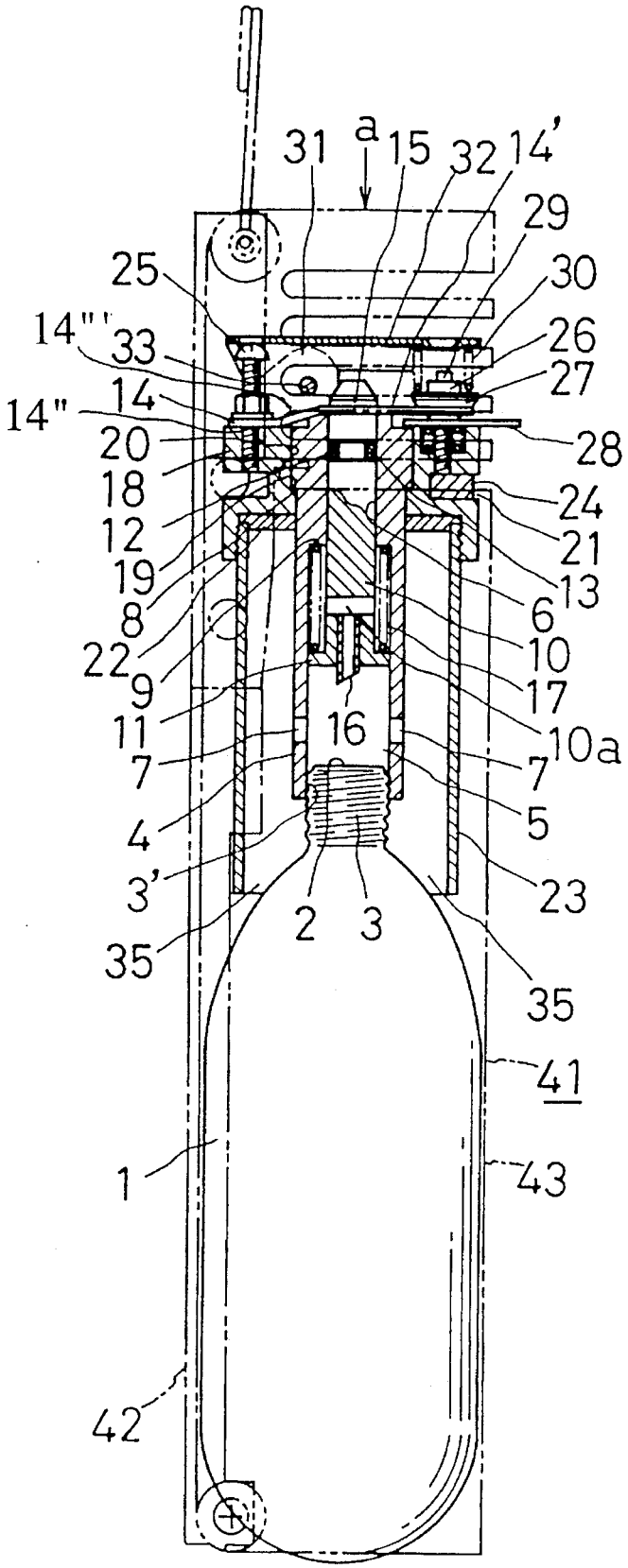
FIG. 1 is a partially sectioned front elevation of an embodiment of the automatic gas injection fire extinguisher according to the present invention.
Figure 2:
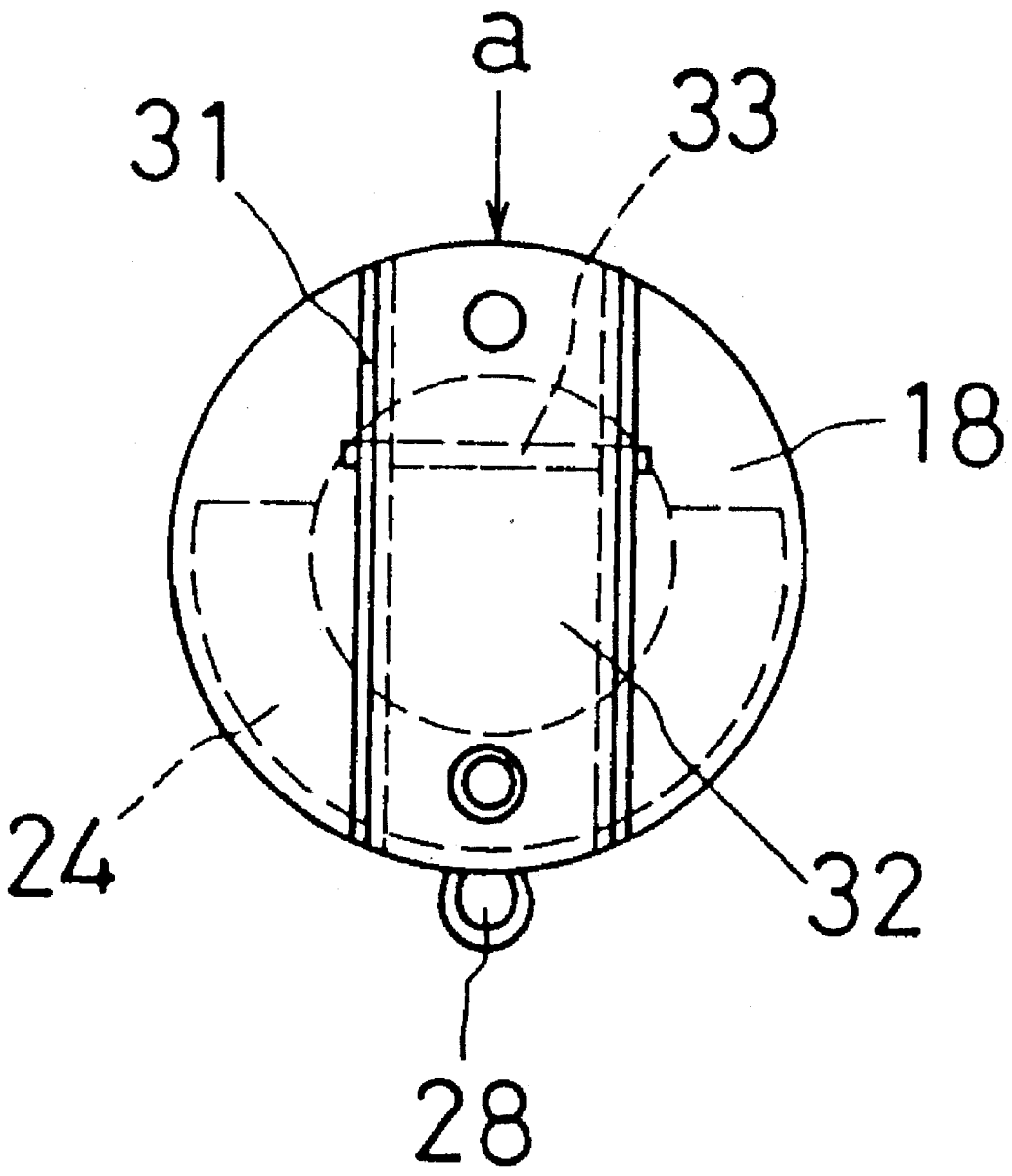
FIG. 2 is a plane view of the embodiment of FIG. 1.
Figure 3:
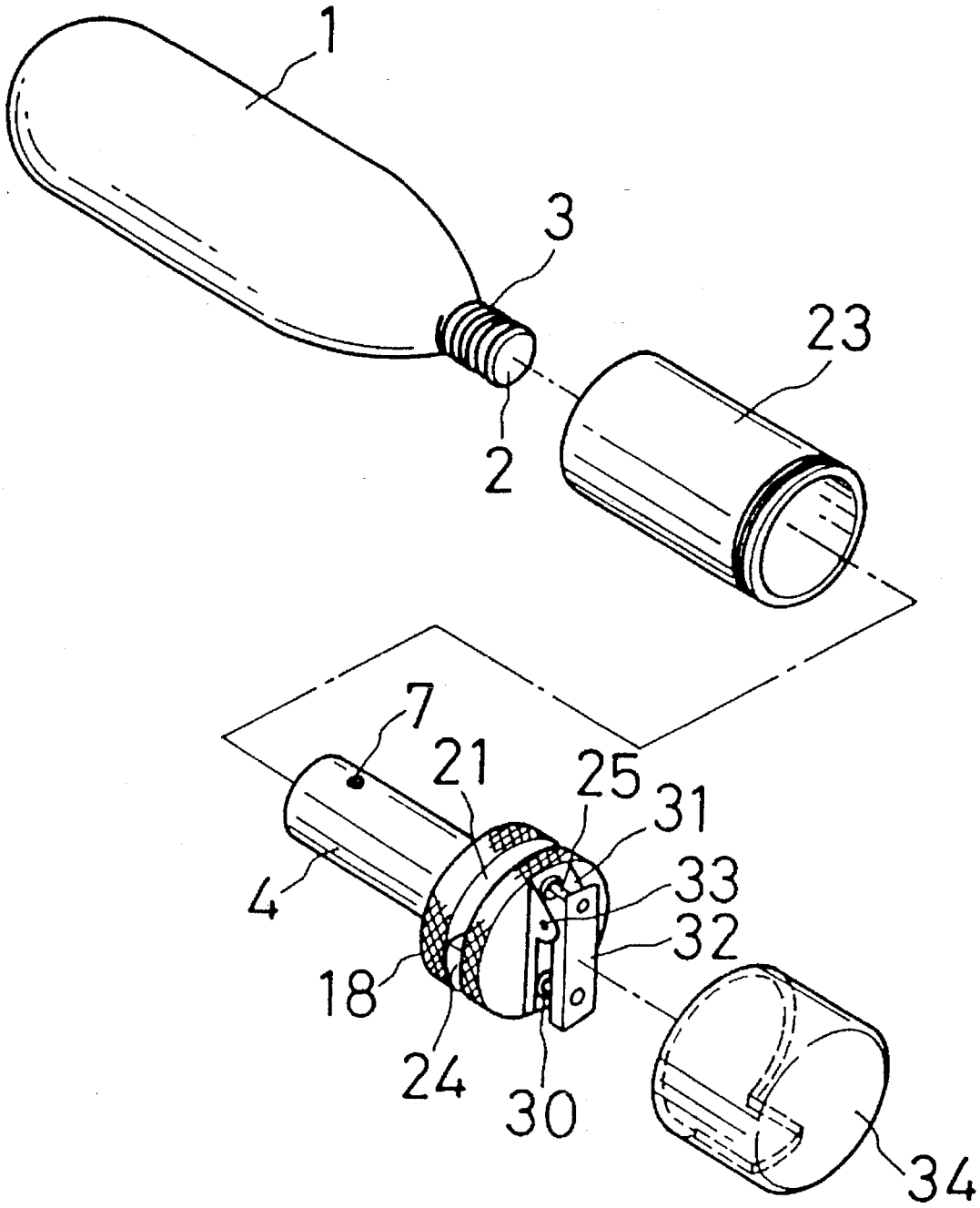
FIG. 3 is an exploded view in perspective of the embodiment of FIG. 1 not yet assembled.
Figure 4:
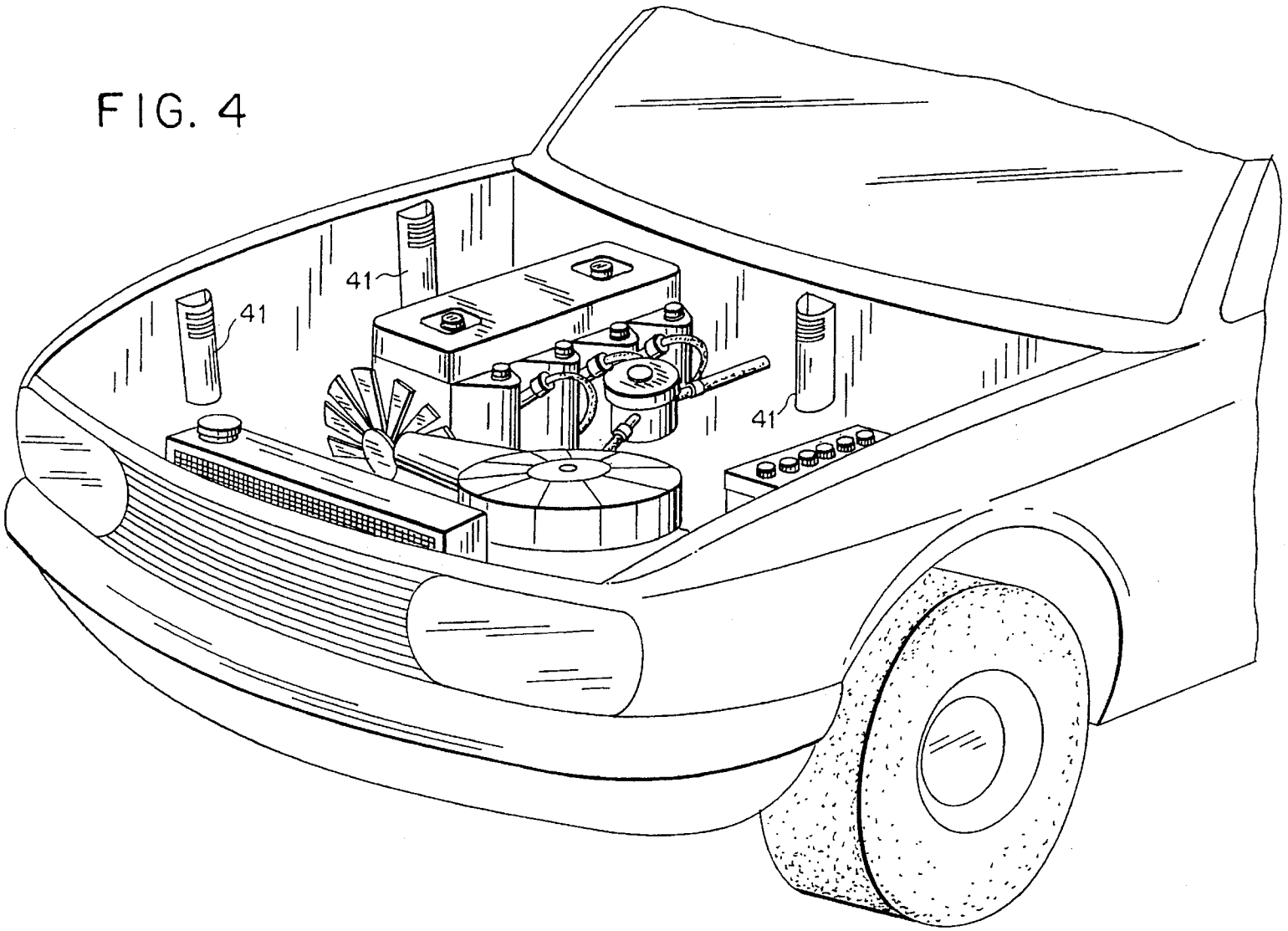
FIG. 4 shows a plurality of the automatic gas injection fire extinguisher according to FIG. 1 in a closed space.
Figure 5:
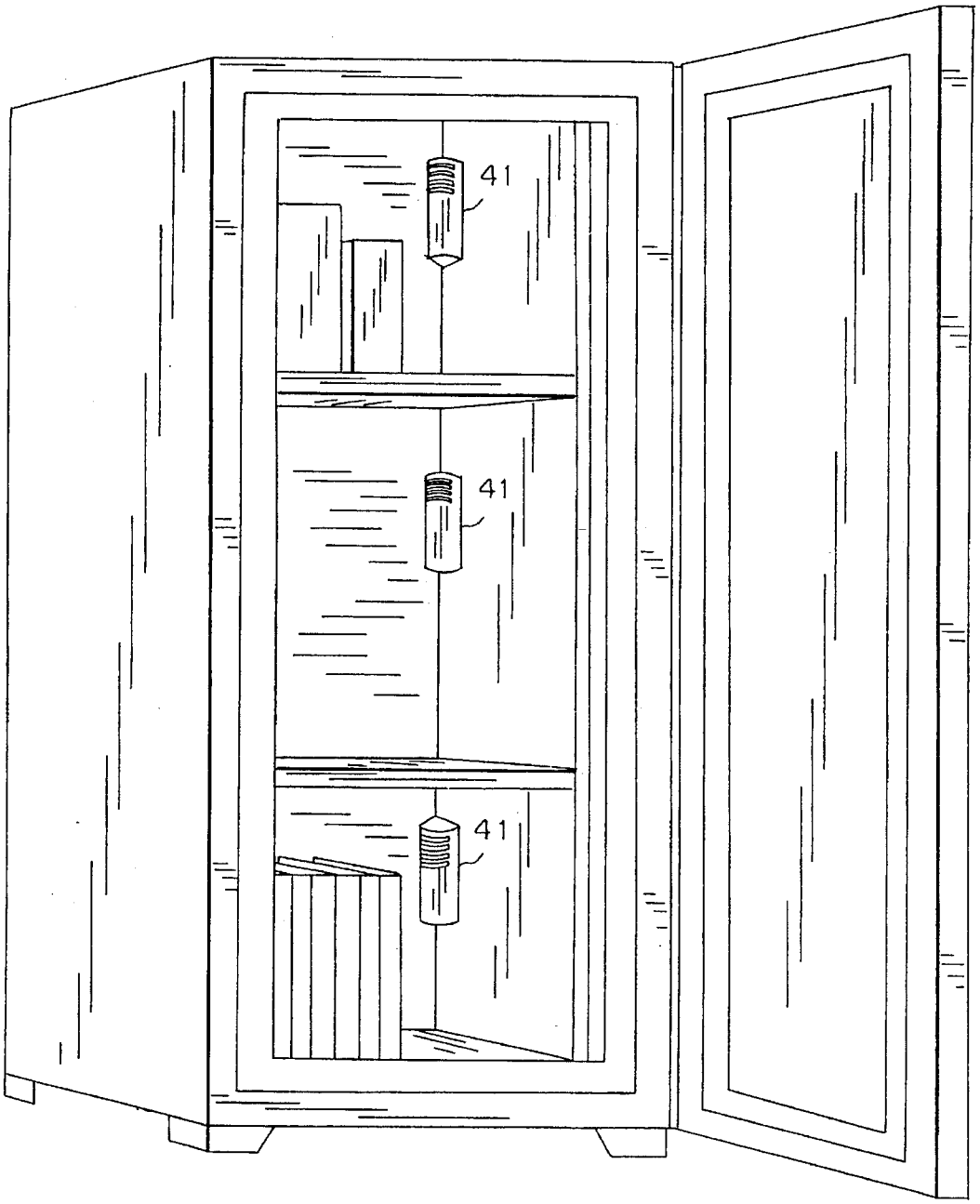
FIG. 5 shows a plurality of the automatic gas injection fire extinguisher according to FIG. 1 in another closed space.

An embodiment of the automatic gas injection fire extinguisher according to the present invention will now be described with reference to the drawings.

Referring to the drawings, a reference letter a denotes an automatic gas injection fire extinguisher provided with a cylinder 1 filled with carbon dioxide, nitrogen, or a gas consisting of a mixture thereof in a liquefied state for use as a fire extinguishing gas, and sealed with a seal member 2. When this kind of gas is gasified, the temperature thereof becomes super-low (for example, −30°—40° C.), and it therefore has a cooling fire extinguishing function. Since such a gas expands explosively (for example, 500 times) with respect to the volume of the same in a liquefied state due to the gasification thereof, it also has an oxygen deficiency fire extinguishing function. In order to have the interior of a room prepared for a fire extinguishing operation, the number of fire extinguishers in the room is regulated so that the total gasification quantity of a gas becomes about ¼ of the volume of the room, whereby the oxygen deficiency fire extinguishing function occurs. The oxygen deficiency fire extinguishing effect is obtained by reducing the oxygen in a room from 21% to around 15%. A thread 3 is provided on the outer circumferential surface of a head portion of the cylinder The automatic injector for a gas injection fire extinguisher a is also provided with a cylinder receiver 4 for fixing the cylinder 1 thereto and retaining the same. The cylinder receiver 4 has a hollow portion or axial through bore 5 in the inner side thereof, and an axial through bore 6, which communicates with the hollow portion 5, in an upper end portion thereof. The cylinder receiver 4 is provided with a pair of ejection ports 7 in a lower portion of the wall of the hollow portion 5. The position in which these ejection ports 7 are provided is above a seal member 2 of the cylinder 1 fixed to the cylinder receiver 4, and below a flange 11 at the lower end of a shaft 10, when the fire extinguisher is inoperative. The diameter of an upper end portion of the cylinder receiver 4 is set slightly larger than its lower end to form a stepped portion 8. The cylinder receiver 4 is further provided on the inner surface of a lower end portion thereof with a thread 3' engageable with the thread on a head portion of the cylinder 1. The diameter of the hollow portion 5 is set larger than that of the through bore 6, and a joint portion between them forms a stepped portion 9.

A shaft 10 is inserted from the lower end of the cylinder receiver 4 so as to pass through the hollow portion 5 and through bore 6. A lower end portion, which is inserted in the hollow portion 5, of the shaft 10 has a flange 11; while an upper end portion thereof which is fitted in the through bore 6 has a recess 13 for fitting an 0-ring 12 therein. The shaft 10 is further provided in the portion thereof which is above the recess 13 with a recess 15 for fitting leg portions 14' of a retainer 14 therein. A firing pin 16, which has a hollow through hole extending axially, projects from one end portion of the shaft 10. The shaft 10 is also provided with a diametrically extending through bore 10a communicating with the through hole of the firing pin 16. A spring 17 is fitted around the shaft 10. The shaft 10 is arranged in the inactive state of the fire extinguisher so that the spring 17 is compressed between the flange 11 of the shaft 10 fitted in the hollow portion 5 and the stepped portion 9 of the cylinder receiver 4. The leg portions 14' of the retainer 14 are fitted in the recess 13 to keep shaft 10 in its inactive state.

The automatic injector for a gas fire extinguisher a is also provided with a fixing member 18 for supporting the cylinder receiver 4. This fixing member 18 has a through bore 20 having a stepped portion 19 which receives the stepped portion 8 on the outer circumferential surface of the cylinder receiver 4. The cylinder receiver 4 is fitted in the through bore 20 and engaged with the stepped portion 19. A recess 21 is formed in the outer circumferential surface of the fixing member 18. A cylindrical member 23 is screwed to an end portion of the fixing member 18 via a packing 22.

An attachment 24 is fitted in one side portion of the recess 21 in the fixing member 18 with a holder fitting portion left empty.

The retainer unit 14 is fixed at its head portion 14' by a bolt 25 screwed to a peripheral portion of the upper surface of the fixing member 18. The retainer unit 14 consists of a spring material and has a pair of leg portions 14' extending via a bent portion 14' from the head portion thereof in the same direction. These leg portions 14' extend so as to normally hold from both sides a tapering portion 27 of a shaft member 26 provided in the part of the peripheral portion of the upper surface of the fixing member 18 which is on the opposite side of the bolt 25. The leg portions 14' of the retainer unit 14 in this condition are fitted in the recess 15 in the shaft 10 to prevent the shaft from being moved down under pressure from spring 17.

The tapering shaft member 26 is fixed to the fixing member 18 by a bolt 29 inserted through the same. A removable safety pin 28 is fitted firmly in a lower surface of the tapering portion 27 of the tapering shaft member 26 so as to prevent a downward movement of the tapering shaft member 26. A spring 30 of a metal with a shape memory, which extends when the temperature thereof becomes, for example, 70°±5° C., is provided in a slightly compressed state on the head portion of the tapering shaft member 26. Lower connector 31 is engaged to the upper surface of the fixing member 18 and to upper connector 32 by a pin 33 so that the connector 32 can be rotated relative to connector 31. The spring 30 of a shape memory metal is engaged at one end on the upper connector 32 which normally presses the tapering shaft member 26 with a low level of force. A cup 34 is positioned over fixing member 18.

The cylindrical member 23 is formed to such a length that the lower end of the fixing member 18 via the packing 22 reaches an inclined portion on the lower side of the head portion of the cylinder 1 to form a clearance 35 between the lower end portion of the cylindrical member 23 and this inclined portion.

These parts form an automatic gas injection fire extinguisher body. The automatic gas injection fire extinguisher a in this embodiment has an extinguisher body constructed as described above, which is housed in a case 41.

The case 41 consists of a mounting plate 42, and a cover 43 attached to the mounting plate 42 so that the cover 43 can be opened and closed. The mounting plate 42 is formed in the shape of a guide rail so that a side portion of the cylinder 1 is fitted shallowly therein, and it is provided at its upper portion with a holder for retaining the extinguisher body fitted in the recess 21 in the fixing member 18.

When a fire occurs in a room in which automatic gas injection fire extinguishers are set and the safety pins 28 are removed, so that the temperature therein reaches a predetermined level, the spring 30 of a shape memory metal of each extinguisher is deformed to press the retainer 14 via the tapering shaft member 26. Consequently, the legs 14' thus pressed are spread apart and opened by the tapering portion 27 of the tapering shaft member 26, and the shaft 10 the flying of which is prevented by the retainer 14 is moved down by the expansive force of the spring 17. The firing pin 16 is then projected suddenly to break the seal member 2 of the cylinder 1. The fire extinguishing gas contained in each cylinder 1 is then ejected, and this gas passed through the interior of the firing pin 16, the through bore 10*a*, and the ejection ports 7 in the cylinder receiver 10, it being then ejected to the interior of the cylindrical member 23 and thereafter to the outside from the clearance 35 between the cylindrical member 23 and cylinder 1.

It will be appreciated that modifications may be made in my invention. For example, this fire extinguisher can also be formed by joining nozzles to the ejection ports of the cylinder receiver so that the fire extinguishing gas is ejected directly from the nozzles to the outside without using the cylindrical member.

Accordingly, it should be understood that the inventor intends to cover by the appended claims all modification falling within the true spirit and scope of our invention.

What is claimed is:

1. A plurality of automatic gas injection fire extinguishers set in a closed space, a number used determined by a volume of said closed space, each of said plurality of said automatic gas injection fire extinguishers comprising:

a cylinder which is filled with a fire extinguishing gas in a liquid state containing at least one of carbon dioxide and nitrogen having a cooling fire extinguishing function based on gasification latent heat of a liquified gas when gasified and an oxygen deficiency fire extinguishing function based on expansion thereof, said cylinder being sealed with a seal member, a firing pin unit for breaking said seal member, a cylinder receiving unit retaining said cylinder and supporting said firing pin unit, a fixing unit for supporting said cylinder receiving unit, a retainer unit for maintaining said firing pin unit in an inoperative state, and a retainer operating device automatically releasing said retainer unit at a predetermined temperature, said retainer operating device having a first spring formed from a metal with a shape memory, said first spring being normally maintained in a slightly compressed state, and expanding at a predetermined temperature, thereby actuating said firing pin unit, breaking said seal member, and releasing said liquified gas, wherein said fixing unit comprises a cylindrical member surrounding said cylinder receiving unit and forming a clearance between an upper end surface of said cylinder and a fully open end of said cylindrical member, gasified liquid gas traveling through said clearance to said closed space.

2. The plurality of said automatic gas injection fire extinguishers according to claim 1, wherein for each said automatic gas injection fire extinguisher, said cylinder has a first thread on an outer circumferential surface of a head portion of the cylinder, and said cylinder receiving unit has:

a second thread engageable with said first thread, said second thread being on an inner surface of a first end portion of said cylinder receiving unit, ejection ports at said first end portion located above said second thread, a first stepped portion formed on a second end portion of said cylinder receiving unit, the head portion of the cylinder being insertable into a hollow portion of said cylinder receiving unit to engage said first thread to said second thread, and an axial through hole at the second end portion of said cylinder receiving unit communicating with the hollow portion and having a diameter which is slightly smaller than that of the hollow portion to form a second stepped portion between the axial through hole and the hollow portion.

3. The plurality of said automatic gas injection fire extinguishers according to claim 2, wherein for each said automatic gas injection fire extinguisher, said firing pin unit comprises:

a first end of a shaft having a flange, a first recess at a second end of the shaft having an O-ring fitted therein, a second recess at the second end of the shaft above the first recess, a firing pin projecting from the first end of the shaft, and a spring surrounding said shaft and being in said hollow portion compressed by said flange against said second stepped portion when the second end of the shaft is inserted into the axial through hole of said cylinder receiving unit, said second end of the shaft being held in the axial through hole when a retainer of said retainer unit is inserted into said second recess.

4. The plurality of said automatic gas injection fire extinguishers according to claim 3, wherein for each said automatic gas injection fire extinguisher, the fixing unit has a through bore with a stepped portion, said cylinder receiving unit is inserted in the through bore to engage a second stepped portion of the cylinder receiving unit against said stepped portion of the fixing unit, an outer circumferential surface of the fixing unit has a third recess to receive an attachment, and an inner surface of a first end portion of the fixing unit has a thread corresponding to a thread on the cylindrical member surrounding the cylinder receiving unit.

5. The plurality of said automatic gas injection fire extinguishers according to claim 3, wherein for each said automatic gas injection fire extinguisher, the retainer unit comprises:

a head portion, and leg portions, said head portion of the retainer unit and the leg portions being connected by a bent portion, said leg portions being inserted into the second recess of the shaft, and a first bolt rotatably engaged to the fixing unit to engage the head portion of the retainer unit to the fixing unit.

6. The plurality of said automatic gas injection fire extinguishers according to claim 5 wherein for each said automatic gas injection fire extinguisher, the retainer operating device further comprises:

a shaft member having a tapering portion inserted between the leg portions of said retainer unit, a safety pin provided below said shaft member, a second bolt screwed to the fixing unit through said shaft member, said first spring being engaged to a head portion of said tapering portion of the shaft member to urge said shaft member, and a connector having a pair of connector members joined to each other pivotably by a pin, one of said pair of connector members being fixed to said fixing member, said one of said pair of connector members being rotatable to keep said connector pressed against said first spring.

7. A plurality of automatic gas injection fire extinguishers set in a closed space, a number used determined by a volume of said closed space, each of said plurality of said automatic gas injection fire extinguishers comprising:

a cylinder which is filled with a fire extinguishing gas in a liquid state containing at least one of carbon dioxide and nitrogen having a cooling fire extinguishing function based on gasification latent heat of a liquified gas when gasified and an oxygen deficiency fire extinguishing function based on expansion thereof, said cylinder being sealed with a seal member, a firing pin unit for breaking said seal member, a cylinder receiving unit retaining said cylinder and supporting said firing pin unit, a fixing unit for supporting said cylinder receiving unit, a retainer unit for maintaining said firing pin unit in an inoperative state, and a retainer operating device automatically releasing said retainer unit at a predetermined temperature, said retainer operating device having a first spring formed from a metal with a shape memory, said first spring being normally maintained in a slightly compressed state, and expanding at a predetermined temperature, thereby actuating said firing pin unit, breaking said seal member and releasing said liquified gas;

wherein said cylinder has a first thread on an outer circumferential surface of a head portion of the cylinder, said cylinder receiving unit having a second thread engageable with said first thread, said second thread being on an inner surface of a first end portion of said cylinder receiving unit, ejection ports at said first end portion located above said second thread, a first stepped portion formed on a second end portion of said cylinder receiving unit, the head portion of the cylinder being insertable into a hollow portion of said cylinder receiving unit to engage said first thread to said second thread, an axial through hole at the second end portion of said cylinder receiving unit communicating with the hollow portion and having a diameter which is slightly smaller than that of the hollow portion to form a second stepped portion between the axial through hole and the hollow portion;

wherein said firing pin unit comprises:

a first end of a shaft having a flange, a first recess at a second end of the shaft having an O-ring fitted therein, a second recess at the second end of the shaft above the first recess, a firing pin projecting from the first end of the shaft, and a spring surrounding said shaft and being in said hollow portion compressed by said flange against said second stepped portion when the second end of the shaft is inserted into the axial through hole of said cylinder receiving unit, said second end of the shaft being held in the axial through hole when a retainer of said retainer unit is inserted into said second recess;

wherein the fixing unit has a through bore with a stepped portion, said cylinder receiving unit being inserted in the through bore to engage a second stepped portion of the cylinder receiving unit against said stepped portion of the fixing unit, an outer circumferential surface of the fixing unit having a third recess to receive an attachment, an inner surface of a first end portion of the fixing unit having a thread corresponding to a thread on the cylindrical member surrounding the cylinder receiving unit; wherein the retainer unit comprises:

a head portion, and has leg portions, said head portion of the retainer unit and the leg portions being connected by a bent portion, said leg portions being inserted into the second recess of the shaft, and a first bolt rotatably engaged to the fixing unit to engage the head portion of the retainer unit to the fixing unit; and wherein the retainer operating device further comprises:

a shaft member having a tapering portion inserted between the leg portions of said retainer unit, a safety pin provided below said shaft member, a second bolt screwed to the fixing unit through said shaft member, said first spring being engaged to a head portion of said tapering portion of the shaft member to urge said shaft member, and a connector having a pair of connector members joined to each other pivotably by a pin, one of said pair of connector members being fixed to said fixing member, said one of said pair of connector members being rotatable to keep said connector pressing against said first spring, wherein said fixing unit comprises a cylindrical member surrounding said cylinder receiving unit and forming a clearance between an upper end surface of said cylinder and a fully open end of said cylindrical member, gasified liquid gas traveling through said clearance to said closed space.

* * * * *